US005101755A

United States Patent [19]

Barrett

[11] Patent Number: 5,101,755

[45] Date of Patent: Apr. 7, 1992

[54] REFLECTIVE INDICATOR FOR HIDDEN OR BURIED UTILITIES

[75] Inventor: Zachary Barrett, Garden Grove, Calif.

[73] Assignee: Gary Cheevers, Norwalk, Calif.

[21] Appl. No.: 611,722

[22] Filed: Nov. 13, 1990

Related U.S. Application Data

[63] Continuation-in-part of Ser. No. 461,655, Jan. 8, 1990, abandoned.

[51] Int. Cl.[5] ..... E01F 9/02; G09F 13/16

[52] U.S. Cl. ..... 116/209; 404/11

[58] Field of Search ..... 40/542, 565, 568, 569, 40/583, 594, 596, 612, 582, 616; 52/103, 105; 116/209; 404/8, 9, 11; 350/100, 107, 109

[56] References Cited

U.S. PATENT DOCUMENTS

| | | | |
|---|---|---|---|
| 1,004,188 | 9/1911 | Olds | 52/103 |
| 1,051,354 | 1/1913 | Strachan | 40/612 |
| 1,521,941 | 1/1925 | Graf | 40/612 |
| 3,396,639 | 8/1968 | Lemelson | 404/8 |
| 3,852,145 | 12/1974 | Kloweit | 40/616 |
| 3,927,637 | 12/1975 | Sammaritano | 116/209 |
| 4,040,760 | 8/1977 | Wyckoff | 404/14 |
| 4,172,063 | 10/1979 | O'Brill | 252/301.16 |
| 4,738,060 | 4/1988 | Marthaler et al. | 52/103 |
| 4,888,896 | 12/1989 | Sanchez | 40/630 |

FOREIGN PATENT DOCUMENTS

| | | | |
|---|---|---|---|
| 535087 | 2/1955 | Belgium | 404/8 |
| 480927 | 3/1938 | United Kingdom | 404/8 |

*Primary Examiner*—William A. Cuchlinski, Jr.
*Assistant Examiner*—W. Morris Worth
*Attorney, Agent, or Firm*—Plante, Strauss & Vanderburgh

[57] ABSTRACT

A system for marking hidden utilities such as buried gas lines, valves and the like includes a marker having highly visible indicia indicating the type of utility on one face and which is bonded to a permanent object adjacent the location of the utility. The highly visible indicia is light reflective or fluorescent or both. The indicia are also recessed in the face of the marker for protection. The marker is affixed to a permanent object such as a curb face or surveying monument in the general location of the utility. The indicia on the marker represent the type of utility and the marker may also contain indicia representing the distance and direction from the marker to the utility location. The system can be provided in kit form which includes, in addition to the marker, a bonding material for affixing the marker to a permanent object and a marker for inscribing information relating to distance and direction on the marker.

10 Claims, 2 Drawing Sheets

REFLECTIVE INDICATOR FOR HIDDEN OR BURIED UTILITIES

RELATIONSHIP AND PENDING APPLICATIONS

This application is a continuation-in-part of co-pending application Ser. No. 461,655, filed Jan. 8, 1990 now abandoned.

FIELD OF THE INVENTION

This invention relates to indicators for buried or hidden utility lines and valves and the like and more particularly to high visibility indicators which are located on a permanent object near a buried or hidden utility.

BACKGROUND OF THE INVENTION

Gas lines, water lines, power lines, valves and switches therefor and the like, referred to herein generally as utilities, conventionally run underground, usually in easements which often extend under or along side of streets and roads. In most cases the shut-off valves and switches which control sections of the utilities are also buried. If not buried, shut-off valves for such utilities are often hidden by brush or tall grass and thus are difficult to locate. In the event of an emergency it is necessary to quickly locate the valve or switch to shut off the utility controlled by the valve or switch. Also, it is necessary to periodically locate and uncover the valves and switches for routine inspection and maintenance. Although the location of water and gas valves and electric utility switches are normally well recorded, the location of the valve or switch is usually available only to the personnel of the utility which installed the valve or switch. Thus, in the case of an emergency it may be difficult for fire or police personnel to locate a water or gas valve or a power switch and shutting off of water, gas or the electricity must wait until the appropriate utility personnel arrive on the scene. In addition, however, even experienced workers may have problems locating a buried valve or switch at night.

For normal inspections and repairs, the location of the valve or switch to be inspected or worked on is first generally located with the aid of a map and the precise location may then be determined using conventional electric or sonic detectors. Often a worker will precede the maintenance crew and paint information relating to its location on the street or curbing, if available. Painted information, besides being unsightly, is quickly worn away and of little value at night or under emergency conditions where experienced workers may not be readily available. Accordingly it would be highly desireable to provide a marking system for utilities which cannot be easily removed and which at the same time is easy to see both during the daytime and at night and which additionally conveys to emergency personnel, as well as to experienced utility workers, the general location of a buried or hidden utility.

SUMMARY OF THE INVENTION

It is an object of the present invention to provide a highly visible marker for designating the general location of buried or hidden utilities such as water and sewer lines and shut-off valves, underground electric conduit and the like.

Another object of the invention is to provide a marking device that is seen at night as well as in daylight and which is adapted to be affixed to roadside curbing or other permanent location near the utility being designated.

Yet another object of the invention is to provide a kit for use by utility workers or the like which is designed to be carried to the work site for the installation of a marking device in accordance with the invention.

Still yet another object of the invention is to provide a marking system for buried utility valves and the like for more readily locating such valves even at night These and other objects, advantages and features of the invention are accomplished by the marker system of the invention which comprises a base having planar rear surface and a front surface adapted to receive indicia for indicating the type of utility being designated. The rear surface of the device is bonded to a permanent object such as the face of a curb or surveying monument so that it cannot be easily removed by weathering or traffic. The indicia are formed of a highly visible material for easy viewing and for visibility at night it is preferred that the indicia also be light reflective. In accordance with the invention the reflective material preferably has a narrow angle of reflectance so that the indicia is not confused with other reflective devices placed in a road surface to designate lanes and center line.

In accordance with the system of the invention, the marker device is positioned at a roadside location of the utility being designated. Preferably, the direction and distance from the marker to the utility is indicated on the marker device when the marker is installed. To locate the utility the distance to the valve is measured in the indicated direction from the marker.

The marker is preferably supplied in kit form which includes a marker device for the type of utility to be designated, a suitable bonding material to affix the marker to curbing or other permanent object and supplies for marking on the device the direction and distance from the marker to the utility.

BRIEF DESCRIPTION OF THE DRAWINGS

The invention will be described in complete detail in the following description of the preferred embodiments taken in conjunction with the drawings in which.

DESCRIPTION OF THE PREFERRED EMBODIMENTS

Figure 1:
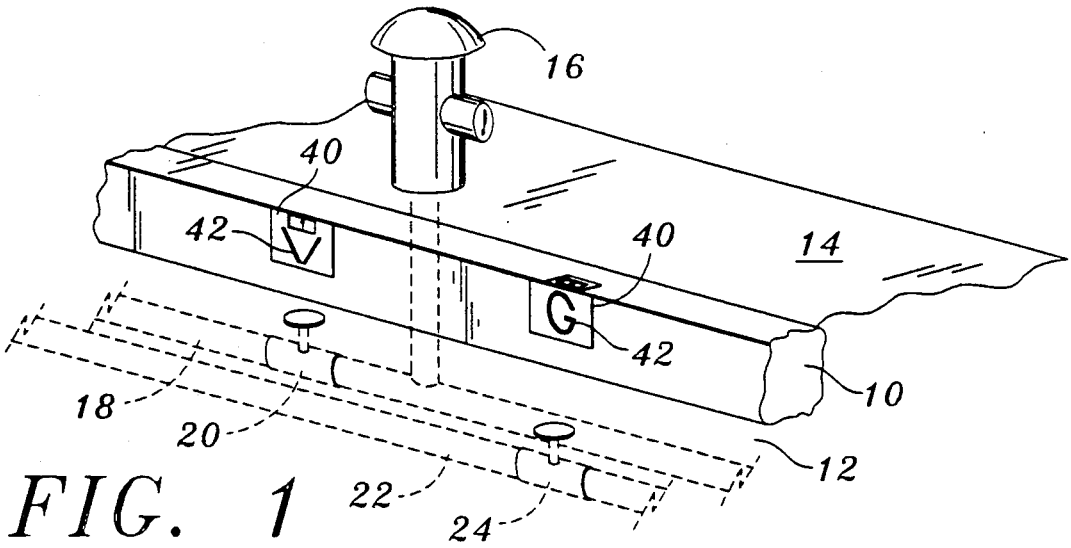
FIG. 1 is a perspective view of a portion of a typical sidewalk and curb construction illustrating the marking device of the present invention disposed on the curb face in accordance with the present invention.

FIG. 1 illustrates a typical sidewalk and street construction in which curbing 10 is disposed along the edge of street pavement 12. In many cases an island 14 separates the sidewalk from the curb, although in an urbanized downtown area a sidewalk will normally extend to the curb. As illustrated, a fire hydrant 16 is disposed in the island 14 and serves as the source of water which is conducted to the hydrant 16 through a buried water line 18. A buried valve 20 is disposed in the line 18 to effect a shutoff of the hydrant. Also illustrated is a gas line 22 which is buried under the street and which includes a buried valve 24 for shutting down the flow of gas to a section of the line 22. As is conventional, these utilities are normally located in easements reserved for that purpose and which lie either along the edge of the roadway or in the island 14.

In accordance with the invention, marking devices 40 are disposed on the vertical face of the curb 10 at the location of the utility being marked. The face of the marker 10 is provided with a readable indicia or a symbol 42 designating the type of valve or utility which is located at or near the location of the marking device 40. As will be explained hereinafter the device 40 may be provided with additional indicia to indicate the direction from the device 40 to the valve or utility line and may also indicate the distance from the marker to the utility.

The marking device 40 comprises a generally planar base 44 having a front surface 46 and a rear surface 48. The base 44 member is preferably formed from a suitable plastic material which is resistant to attack by salts and the like which are placed on the streets as well as the effects of sunlight, temperature changes and the like. A number of suitable materials include acrylic nitrile butadiene styrene polymers, acetal co-polymers, acrylic polymers, polybutylene polymers, polyester polymers, styrene acrylic nitrile polymers (SAN), and various poly-blends or alloys thereof such as ABS/PVC, PVC/acrylic, ABS/poly sulfone, SAN/poly sulfone. A portion of the front surface 46 of the device 40 is recessed at 50 and a highly visible material 52 is disposed in the recess 50 to define the symbol 42. The upper surface of the highly visible material 52 is disposed below the outer surface of the base 44 of the marker device 40 so that it is protected from marring or scuffing by road traffic, street cleaning equipment and other roadside hazards. The highly visible material 52 is preferably selected from relatively high impact strength polymeric and copolymeric materials used in the base 44 which contain fluorescent color additives for high visibility both during the daylight hours and at night when exposed to a beam of light. Such special color additives are conventional in the art and exhibit sufficient color intensity and light fastness along with good resistance to chemicals and solvents to make their use practicable. Such materials include the fluorescent pigments supplied by DAYGLO COLOR CORP., Cleveland, Ohio. For maximum night visibility a light reflective material can be used to define the symbol 42 with good results. It is preferred that the reflective material itself have a narrow angle of reflectance to avoid confusing the marker device 40 with other reflective objects in the road such as for example the so called "Botts Dots" which are placed in the road surface to designate center line and lane areas and fire hydrants Having the symbol 42 recessed below the surface of the marker is also an aid in reducing the angle of reflectance, although it is not essential. By maintaining a narrow angle of reflectance, the marker 40 is not easily seen when viewed from the side and there is relatively little or no reflectance when viewed at an angle greater than the angle of reflectance. Good results have been achieved with an angle of reflectance on the order of about 15. in either direction from a line extending normal to the front face of the marker 40, although this angle may be made smaller or larger as a matter of choice. The reflective material preferably consists of a SAN resin such as supplied under the mark LUCITE by the E. I. DU PONT DE NEMOURS AND COMPANY, Wilmington, Del., or LUSTRAN as supplied by MONSANTO CHEMICAL COMPANY, St. Louis, Mo. The reflective material can also include a special color additive, preferably one that will provide daylight fluorescence to make the indicia on the marker highly visible in daylight.

The marker device 40 is bonded to the face of the curbing 10 with a suitable bonding material, such as for example an epoxy adhesive. In the alternative, however, in the event new curbing 10 is being poured, the marker can be inset directly into the freshly poured concrete so that the marker becomes an integral part of the curb.

Figure 2:
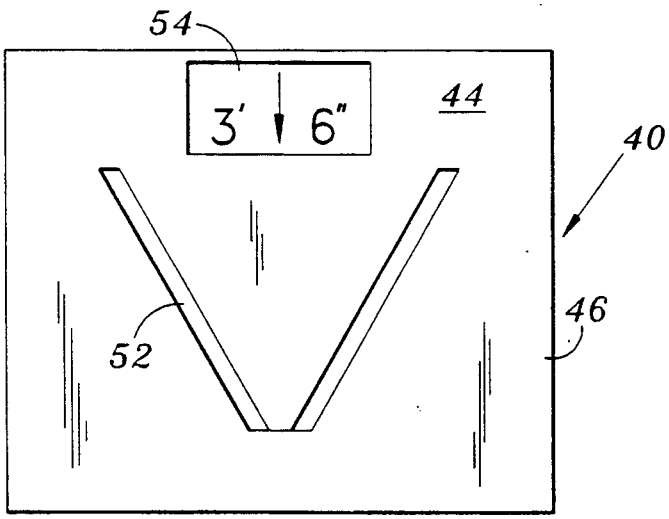
FIG. 2 is a front elevation of a marking device in accordance with the invention.
Figure 3:
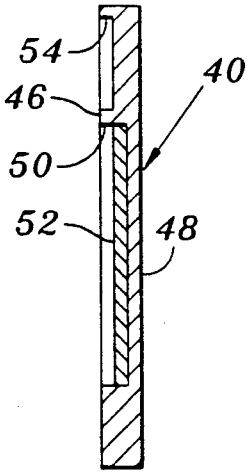
FIG. 3 is a side sectional view taken through line 3—3 of FIG. 2.
Figure 4:
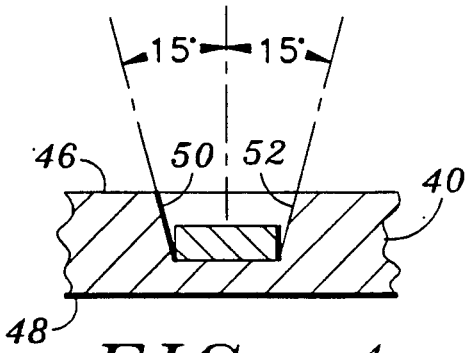
FIG. 4 is a side sectional view in enlarged scale of the marker device of FIG. 2 with portions cut away for compactness of illustration.

Preferably, the front face 46 of the base 44 includes an additional recessed area 54 for containing information relating to the direction and distance from the marker 40 to the utility as measured from the marker 40. As indicated in FIG. 2, the arrow is pointing downward indicating that a utility, for example, the water shut-off valve 20 of FIG. 1 is located perpendicularly to the front face 46 of the marker device 40. If the arrow were to point up, the utility being designated would be located in the direction of the arrow from the rear of the marker device 40. In addition, the notation 3'6" is included to designate that measuring in the direction of the arrow a distance of 3 feet 6 inches will locate the buried valve or utility being designated by the marker. The directional and distance information can be impressed in the recessed area 54 using a heated stylus or the like. In the alternative the information can be written with a suitable marker pen in the recessed area 54 and preferably coated with a weatherproof coating such as a clear ABS coating, mylar tape or the like.

In accordance with the marking system of the present invention, the marker device 40 is located along the face of the curbing 10 in the general area of the utility being designated. Preferably, the marker is located on the curb face so that the utility being designated is located along a line perpendicular to the front face 46 of the marker device 40. However, when employing the preferred form of the invention, where the direction and distance are indicated on the marker device 40, the line from the marker to the utility is not necessarily perpendicular to the front face 46 of the marker but is indicated by the direction that the arrow is pointing. With the direction and distance indicated on the marker face, it is necessary only to measure from the marker in the direction of the arrow, the distance indicated to locate the valve or other utility being designated. It should be noted that although the description heretofore has been in connection with buried utilities, valves and the like, markers are highly useful in areas where there is underbrush or grass or the like which may obscure the location of an above ground utility, particularly at night.

Figure 5:
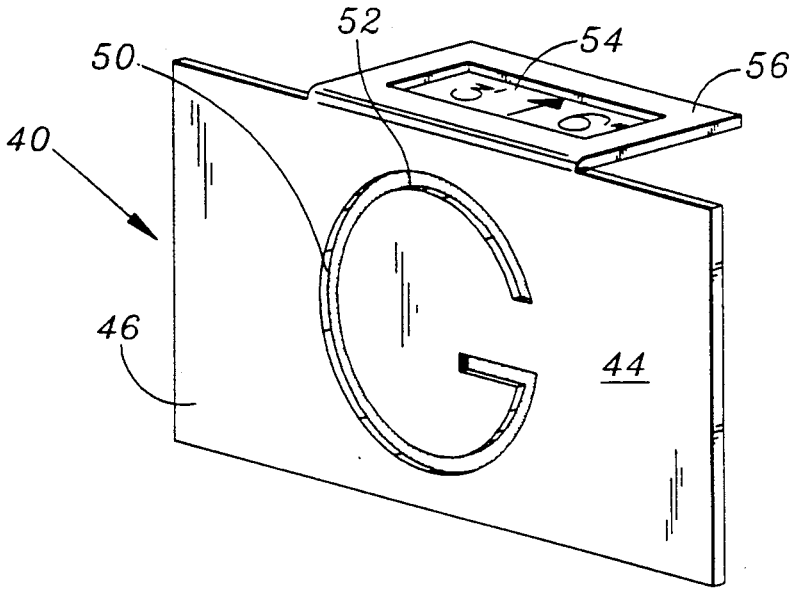
FIG. 5 is a perspective view of another embodiment of the marking device of the present invention.
Figure 6:
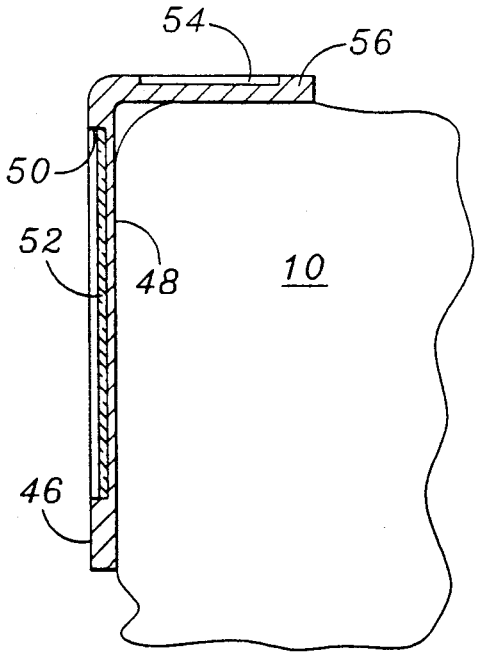
FIG. 6 is a side sectional view taken through line 6—6 of the device shown in FIG. 5.

Referring to FIG. 5 and 6, there is illustrated another embodiment of the device 40 of the present invention, in which the upper edge of the base 44 is extended essentially normal to the plane of the rear face 48 of base 44 to define a flange 56 which extends rearwardly from the base 44. The upper surface of the flange 56 is provided with the recessed area 54 for designating direction and distance to the utility designated by the marker. As is most clearly indicated in FIG. 6, the marker 40 is installed on the face of the curbing 10 as previously described so that the flange 56 rests upon the top surface of the curb. Both the under surface of the flange 56 and the rear face 48 of the base 44 are secured to the curb with a suitable bonding material.

The precise nature of the indicia may vary from area to area although it is proposed that the letter V be used to indicate a water valve, the letter G to indicate a gas line valve, the letter E to indicate electrical lines, the letter T for telephone switch boxes and the letter S to indicate sewer lines.

The marker device 40 of the present invention is conveniently provided in kit form which includes the marker 40, a bonding material for fixing the marker to the curb face, a suitable marking instrument to indicate direction and distance on the device 40 and protective material, such as a clear epoxy or ABS coating material, which can be put over the direction and distance markings to provide a weatherproof protective coating. The components are packaged in a suitable container which would indicate the type of marking device contained in the package. The kits then can be conveniently carried by utility personnel for installation.

The markers of the present invention are advantageously used to designate the location of underground utilities or utilities which are otherwise hidden from view, particularly at night. A reflective material having a small angle of reflectance is utilized to make the marker readily visible at night and preferably the reflective material contains a fluorescent color additive to aid in locating the marker in the daylight hours. The marker is inexpensive and easy to use and superior to the conventional methods for designating the location of hidden utilities. Moreover, the markers are readily usable by emergency personnel who are not familiar with the location of utilities to locate shut off valves for hydrants and ruptured water lines and the like. utilizing markers and the marking system of the present invention, it will be possible to substantially reduce the cost of having utility personnel on standby during off duty hours in order to be available to locate shut off valves and the like and turn off utilities in the event of emergency situations.

As will be understood by those skilled in the art, various arrangements other than those described in detail in the specification occur to those persons skilled in the art, which arrangements lie within the spirit and scope of the invention. It is therefor to be understood that the invention is to be limited only by the claims appended hereto.

Having described the invention, I claim:

1. A marking system for buried utility valves and the like comprising:

(a) a marker device which comprises a base having planar rear surface and a front surface adapted to receive indicia indicating the type of utility being designated;

(b) said planar rear surface of said marker device adapted to be essentially permanently bonded to a permanent object;

(c) a portion of said front surface of said marking device being recessed and said indicia is disposed therein to lie below the plane of the unrecessed portion of said front surface;

(d) said indicia being formed of a highly visible material selected from the group consisting of material containing fluorescent color additives and light reflective materials having a narrow angle of reflectance and combinations thereof;

whereby said marker device is positioned at the location of the utility being designated, said marker indicia designating the type and location of said utility.

2. The utility marking system of claim 1 wherein said indicia comprises a material containing fluroescent color additives.

3. The utility marking system of claim 1 wherein said indicia comprises a light reflective material having a narrow angle of reflectance.

4. The utility marking system of claim 3 wherein said light reflective material has an angle of reflectance of about 15° in either direction from a line extending normal to said front surface of said marker.

5. The utility marking system of claim 3 wherein said light reflective material includes a fluorescent pigment to improve visibility of said indicia during daylight hours.

6. The utility marking system of claim 1 wherein said marker devices is permanently bonded to a curb face adjacent the location of a utility to designate the location thereof.

7. The utility marking system of claim 1 wherein one edge of said marker device is extended essentially normal to the plane of said rear surface of said marker to define a flange extending rearwardly from said marker device.

8. A kit for designating the location of a hidden utility, said kit comprising:

(a) a marker device which comprises a base having planar rear surface and a front surface adapted to receive indicia indicating the type of utility being designated, said planar rear surface of said marker device adapted to be bonded to a permanent object, said front surface being recessed and carrying indicia therein to lie below the plane of the unrecessed portion of said front surface, said indicia indicating the type of utility being designated, said indicia being formed of a highly visible material selected from the group consisting of light reflective materials having a narrow angle of reflectance and material containing fluorescent color additives;

(b) bonding material for affixing said marker to said permanent object;

(c) means for inscribing on said marker information relating to direction and distance from said marker to said utility; and (d) a suitable container for said kit components.

9. A marking system for buried utility valves and the like comprising:

(a) a marker device which comprises a base having planar rear surface and a front surface adapted to receive indicia indicating the type of utility being designated;

(b) said planar rear surface of said marker device adapted to be essentially permanently bonded to a permanent object;

(c) a portion of said front surface of said marking device being recessed and said indicia is disposed therein to lie below the plane of the unrecessed portion of said front surface;

(d) said front surface of said marker including a second recessed area and indicia for the display of information relating to the direction and distance from the marker to the location of a utility is disposed therein to lie below the plane of the unrecessed portion of said front surface;

(e) said indicia being formed of a highly visible material selected from the group consisting of material containing fluorescent color addities and light reflective materials having an angle of reflectance of 15° in either direction, and combinations thereof;

whereby said marker device is positioned at the location of the utility being designated, said marker indicia designating the type and location of said utility.

10. A marking device for buried utility valves and the like comprising:

(a) a marker device which comprises a base having planar rear surface and a front surface adapted to receive indicia indicating the type of utility being designated, one edge of said marker being extended essentially normal to the plane of said rear surface of said marker to define a flange extending rearwardly from said marker and defining an upper surface adapted to receive indicia for indicating the direction and distance from said marker device to said utility;

(b) said planar rear surface of said marker device adapted to be essentially permanently bonded to a permanent object;

(c) a portion of said front surface and said upper surface of said flange of said marking device being recessed and said indicia is disposed therein to lie below the plane of the unrecessed portion of said front surface and said upper surface of said flange;

(d) said indicia being formed of a highly visible material selected from the group consisting of material containing fluorescent color additives and light reflective materials having a narrow angle of reflectance and combinations thereof;

whereby said marker device is positioned at the location of the utility being designated, said marker indicia designating the type and location of said utility.

* * * * *

UNITED STATES PATENT AND TRADEMARK OFFICE

CERTIFICATE OF CORRECTION

PATENT NO. : 5,101,755

DATED : April 7, 1992

INVENTOR(S) : Zachary Barrett

It is certified that error appears in the above-identified patent and that said Letters Patent is hereby corrected as shown below:

Col. 7, Line 1, delete "addities" and insert --additivies--

Signed and Sealed this

Twenty-eighth Day of September, 1993

Bruce Lehman

*Attest:*

BRUCE LEHMAN

*Attesting Officer*

*Commissioner of Patents and Trademarks*